US005273281A

United States Patent [19]

Lovell

[11] Patent Number: 5,273,281

[45] Date of Patent: Dec. 28, 1993

[54] GAME CARD AND ASSOCIATED PLAYING METHOD

[76] Inventor: John G. Lovell, 3222 Rudy St., Knoxville, Tenn. 37922

[21] Appl. No.: 950,297

[22] Filed: Sep. 24, 1992

[51] Int. Cl.[5] ..... A63F 3/06

[52] U.S. Cl. ..... 273/138 R; 273/269; 283/903

[58] Field of Search ..... 273/139, 138 R, 272, 273/240, 269; 283/903

[56] References Cited

U.S. PATENT DOCUMENTS 4,832,341 5/1989 Muller et al. ..... 273/138

5,106,089 4/1992 Wood ..... 273/240

*Primary Examiner*—Benjamin H. Layno

*Attorney, Agent, or Firm*—Pitts & Brittian

[57] ABSTRACT

A game card and associated playing method. The game card is used for playing a number game of chance in which players guess a sequence of a sub-group of said randomly generated numbers. The game card and associated playing method comprises a game card printed with a series of numbers divided into groups of numbers each group being associated with a group designator. The player indicates her guess by selecting the group designator which either matches her guess or is associated with the group which contains her guess. The game cards are marked so as to allow scoring by an optical scanner. The player which correctly guesses the identity and sequence of a sub-group of randomly generated numbers, such as are randomly generated during a bingo or keno game or during a lottery, is the winner.

24 Claims, 4 Drawing Sheets

GAME CARD AND ASSOCIATED PLAYING METHOD

TECHNICAL FIELD

This invention relates to the field of number games of chance such as lotteries, bingo, keno etc. More particularly it relates to a game card for playing such games and an associated playing method.

BACKGROUND ART

In number games, such as bingo and keno, the object is to fill in a prearranged pattern as numbers, e.g. one through seventy five for bingo, are called at random. As these numbers are called at random, a secondary game can be played simultaneously. This secondary game allows the players to guess a designated quantity of numbers, i.e. guess three numbers or guess five numbers, and guess the sequence that these numbers will be randomly generated during the initial moments of the primary game, i.e. the players guess five of the first fifteen numbers called and can be rewarded for correctly guessing all correct numbers and can also be rewarded for correctly guessing the sequence in which the numbers were randomly generated.

This secondary game is a game of chance, in which players select or guess a series of numbers in anticipation of the selected numbers matching, in identity and/or sequence, a series of randomly generated numbers or an undisclosed, preselected series of numbers. The players are rewarded based on the accuracy of their guess.

A logistical problem with this secondary game is documenting each player's guess and verifying the accuracy of each player's guess for purposes of rewarding players making accurate guesses. One solution that is common involves each player manually marking multiple game cards with his or her guesses. Then the players cards are manually checked in order to determine a winner.

An additional problem encountered with this secondary game is associated with the player's perception of the odds of guessing correctly. For instance, during a bingo type game, if players are given the opportunity to guess five of the first fifteen numbers called, the player perceives that he or she is choosing five numbers out of a possible seventy-five. This perception can result in low player participation in the secondary game. What is needed is a means of altering the player's perception of the odds of guessing correctly by lowering the apparent range of numbers to choose from or by making each guess equal to a group of numbers. Also needed, to facilitate the process of verification of the accuracy of each player's guesses is a playing card that can be scored by optical or magnetic card readers.

A prior disclosed game card is described in U.S. Pat. No. 4,832,341, which issued to Muller et al. on May 23, 1989. Muller discloses an instant lottery card that utilizes bar codes, such as a UPC code and an associated bar code reader. A list of lottery numbers are generated at random and each lottery number is printed in its bar code format on a lottery card. Muller's game card is designed, for security purposes, to prevent the lottery number on a card from being discerned prematurely. Muller's game card is not designed to solve the problems discussed above.

Accordingly, it is an object of this invention to provide a game card and an associated playing method that alters a players perception of the odds of correctly guessing the identity and sequence of a series of randomly generated numbers.

Yet another object of the present invention to provide a game card and an associated playing method in which a player can guess on a series of alphanumeric characters and/or icons in which each alphanumeric character and/or icon is equivalent to a limited group of numbers from a range of randomly generated numbers.

Still another object of the present invention is to provide a game card and associated playing method in which a player's guesses are recorded so as to allow verification of the accuracy of the player's guesses by an optical or magnetic reader.

Other objects and advantages over the prior art will become apparent to those skilled in the art upon reading the detailed description together with the drawings as described as follows.

DISCLOSURE OF THE INVENTION

In accordance with the various features of this invention, a game card and an associated playing method is provided. The game card has groups of numbers and each group of numbers has a group designator. The group designator can be the first number in each group, an alphabetic character or a unique graphical symbol which will be referred to in this disclosure as an icon. The game card is also provided with a space, in conjunction with each group of numbers, for a player to register his selection of a given group of numbers. The associated playing method requires the player to guess a number, in order to register his or her guess on the playing card the player selects the group of numbers which contains the guessed number and makes an appropriate mark on or around the group designator associated with the particular group of numbers. The player's guess is effective for each number within the group of numbers selected. Thus, depending upon the quantity of numbers within the group selected, the player's chances at correctly guessing a given number are increased. A game card can contain a plurality of games and sub-games which require a player to guess a set of numbers and/or the sequence of the guessed numbers in a series of randomly generated numbers. The game card also allows the player to designate which of the plurality of sub-games the player wishes to play and the number of rounds of a given game or sub-game during which the player's guesses are valid.

BRIEF DESCRIPTION OF THE DRAWINGS

The above mentioned features of the invention will become more clearly understood from the following detailed description of the invention read together with the drawings in which.

BEST MODE FOR CARRYING OUT THE INVENTION

Figure 6:
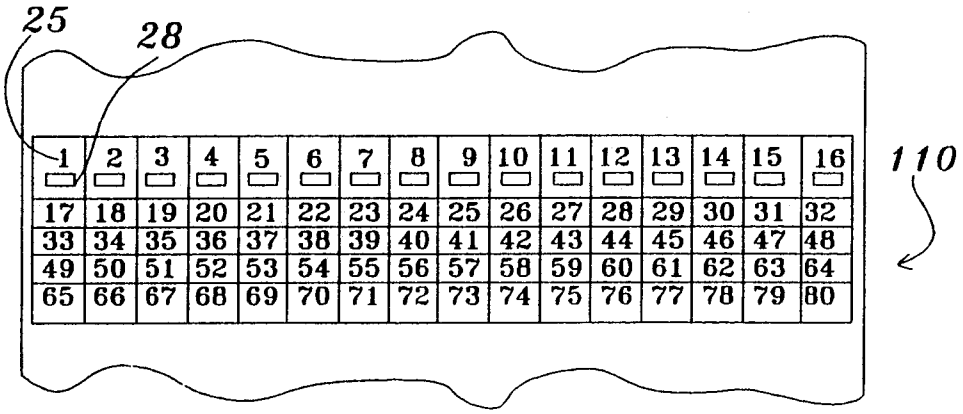
FIG. 6 illustrates an alternate embodiment of the game card of the present invention for use during a keno game.
Figure 7:
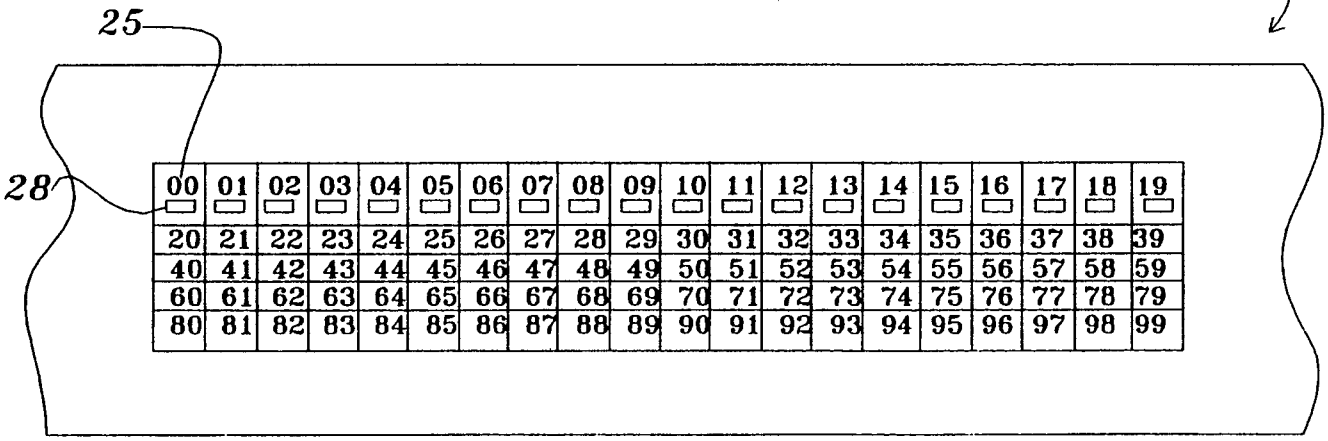
FIG. 7 illustrates an alternate embodiment of the game card of the present invention for use in a lottery type game.

A game card for playing a lottery type game during bingo or keno type games constructed in accordance with the present invention is illustrated generally at 10 in the Figures. It will be recognized by those skilled in the art that the game card depicted and described would be used during bingo type games; it being recognized that the game of bingo uses the numbers one through seventy-five. This is done for simplicity of illustration and discussion and is not intended to limit the scope of the present invention. It will be recognized that the game card and associated playing method of the present invention is readily adaptable to keno type games, as seen at 110 in FIG. 6, which use eighty numbers. The game card could also be adapted for other types of lottery games, as seen at 110' in FIG. 7, which call on the player to guess the identity and sequence of a limited quantity of randomly generated numbers. The game card 10 and its associated playing method will be discussed first with reference to the game card and secondly with regard to the associated playing method.

Figure 1:
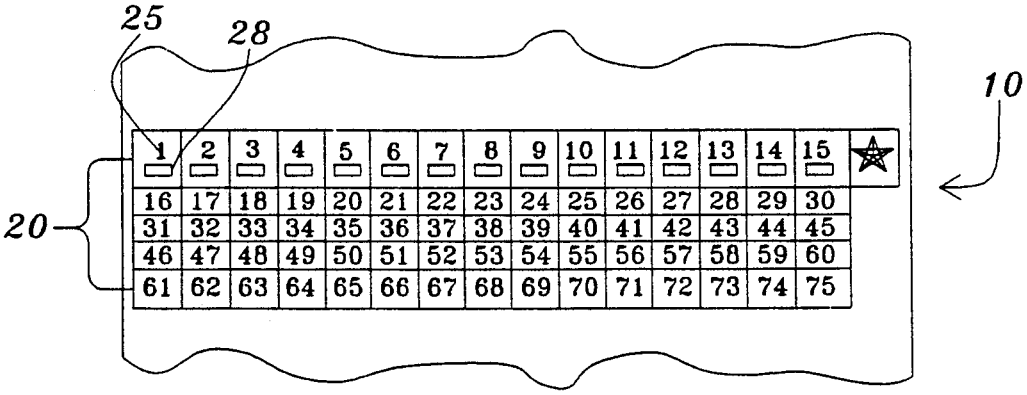
FIG. 1 illustrates a portion of an embodiment of the game card of the present invention for use during a bingo type game in which each group is designated by the first number in the group.
Figure 2:
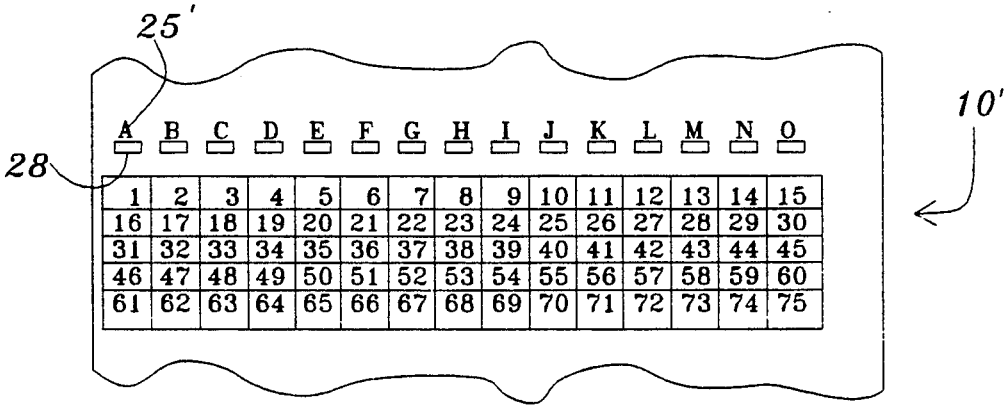
FIG. 2 illustrates a portion of an embodiment of the game card of the present invention for use during a bingo type game in which each group is designated by an alphabetic character.
Figure 3:
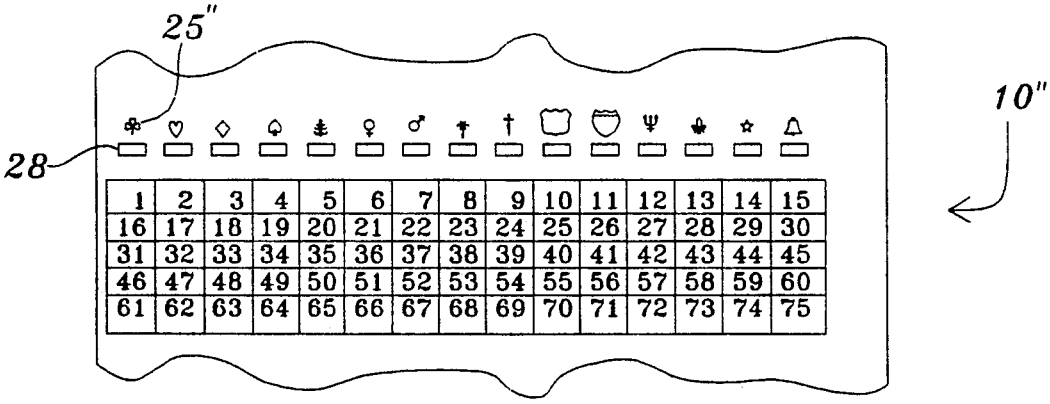
FIG. 3 illustrates a portion of an embodiment of the game card of the present invention for use during a bingo type game in which each group is designated by an icon.

As seen in FIG. 1, game card 10 has a series of numbers, one through seventy-five in the preferred embodiment, divided into fifteen groups 20. It will be recognized by those skilled in the art that for a keno type game, the numbers one through eighty would be used. Each group 20 can be selected by making an appropriate mark on or around the group designator 25. For instance the group 20, which contains the numbers one ("1"), sixteen ("16"), thirty-one ("31"), forty-six ("46") and sixty-one ("61") can be selected by making an appropriate mark on or around that group's numeric group designator 25. Group 20's numeric group designator 25 is the number one ("1"). As can be seen in FIGS. 2 and 3, the group designator can be an alphabetic character, 25' in FIG. 2, or an icon 25" in FIG. 3. In the preferred embodiment, numeric group designator 25 is selected by shading in field 28. Game card 10 is then scored by an optical reader/scanner such as is used to score standardized tests. It will be recognized that field 28 could be circular, elliptical or rectangular as depicted. Each group designator 25 would have an associated field 28. While in the preferred embodiment, game card 10 is scored by an optical scanning type device, it is understood that game card 10 could be manually scored. In an alternate embodiment, game card 10 would be graphically projected upon a computer monitor such as is commonly used on coin-operated video games. Game card 10 would, in this embodiment, be computer scored.

Figure 4:
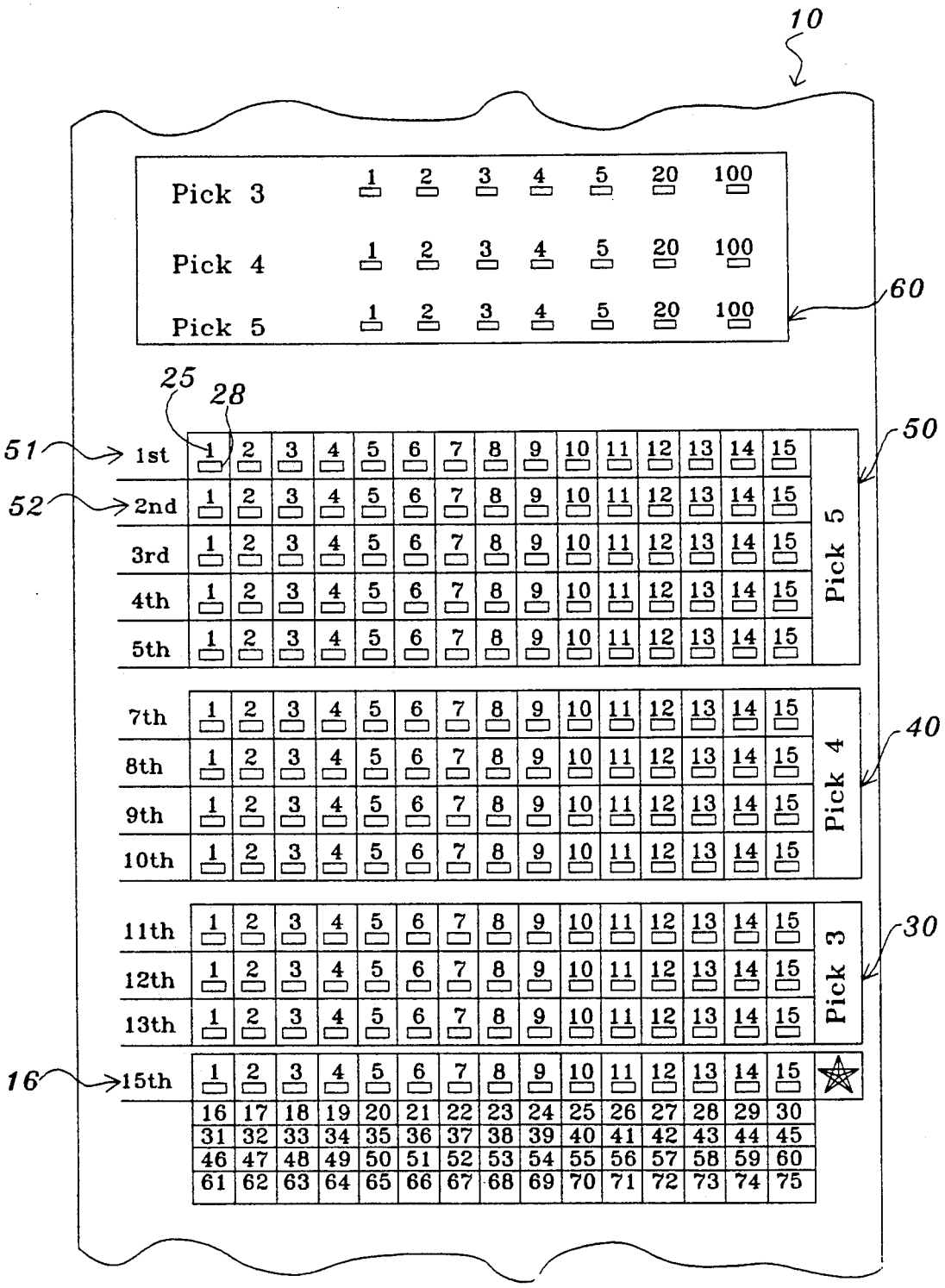
FIG. 4 illustrates an embodiment of the game card of the present invention which allows the player to play a plurality of games and which can be scored by an optical scanner.

In the preferred embodiment, the game card offers the player a plurality of guessing games. Referring to FIG. 4, game card 10 is shown with four guessing games from which a player can choose. Game card 10 allows the player to choose to play a game wherein the player guesses five numbers, game 50, and/or the player can choose to play a game wherein the player guesses four numbers, game 40. In a similar fashion, game card 10 also allows the player to choose to play a guessing game wherein the player guesses three numbers, game 30. Game card 10 also has a game 16 wherein a player attempts to guess a single number. In the preferred embodiment, game card 10 is provided with region 60 wherein a player can select the number of rounds his or her guesses in games 30, 40 and 50, respectively, are to be scored.

Play, in accordance with the associated playing method is as follows. As explained above, a secondary game that is often played during bingo type games calls on the players to guess the identity and sequence of a sub-group of numbers from a designated series of numbers, such as the first fifteen bingo numbers called during a single game of bingo. By playing with game card 10, a player would effectively be guessing five numbers with one guess and either of these five numbers, if called in the sequence guessed by the player would be counted as a correct guess, i.e. by choosing numeric group designator 25 which is associated with the numeral one, the player would, of course, be given credit if the number one is called (B-1 in bingo). However the player would also be credited with a correct guess if the number sixteen (I-16), the number 31 (N-31), the number 46 (G-46) or the number 61 (O-61) were called, thus the player perceives greater odds of guessing correctly.

Referring to FIG. 4, a player would first choose which of the three games 30, 40 and 50, respectively, he wished to play and the number of rounds he or she wanted to use the marked guesses by marking the appropriate field in region 60. Game 50 requires the player to guess the first, second, third, fourth and fifth numbers called during a bingo type game. The player would mark his or her guess in the appropriate row, i.e. his or her guess for the first number would be marked in row 51 which is labeled "1st". Likewise, the player would mark his or her guess for the first number would be marked in row 52 which is labeled "2nd". The player would similarly mark his or her guess for the third, fourth and fifth guess in the appropriate fields. Similarly, the player would mark his or her guesses for game 40 and for game 30. In one embodiment, the player could make a single guess in row 16. It will of course be recognized by those skilled in the art that each game could vary and the sequence of guesses could vary, i.e., it is contemplated that in a guessing game which requires the player to guess five numbers, the player could be called on to guess the first, third, fifth, seventh and ninth numbers called during a round of bingo. It is of course understood, that in the alternate embodiment in which the game card is graphically displayed on a video-game monitor, that the player would register his guesses by inputting the guesses with any commonly used video-game input device.

Figure 5:
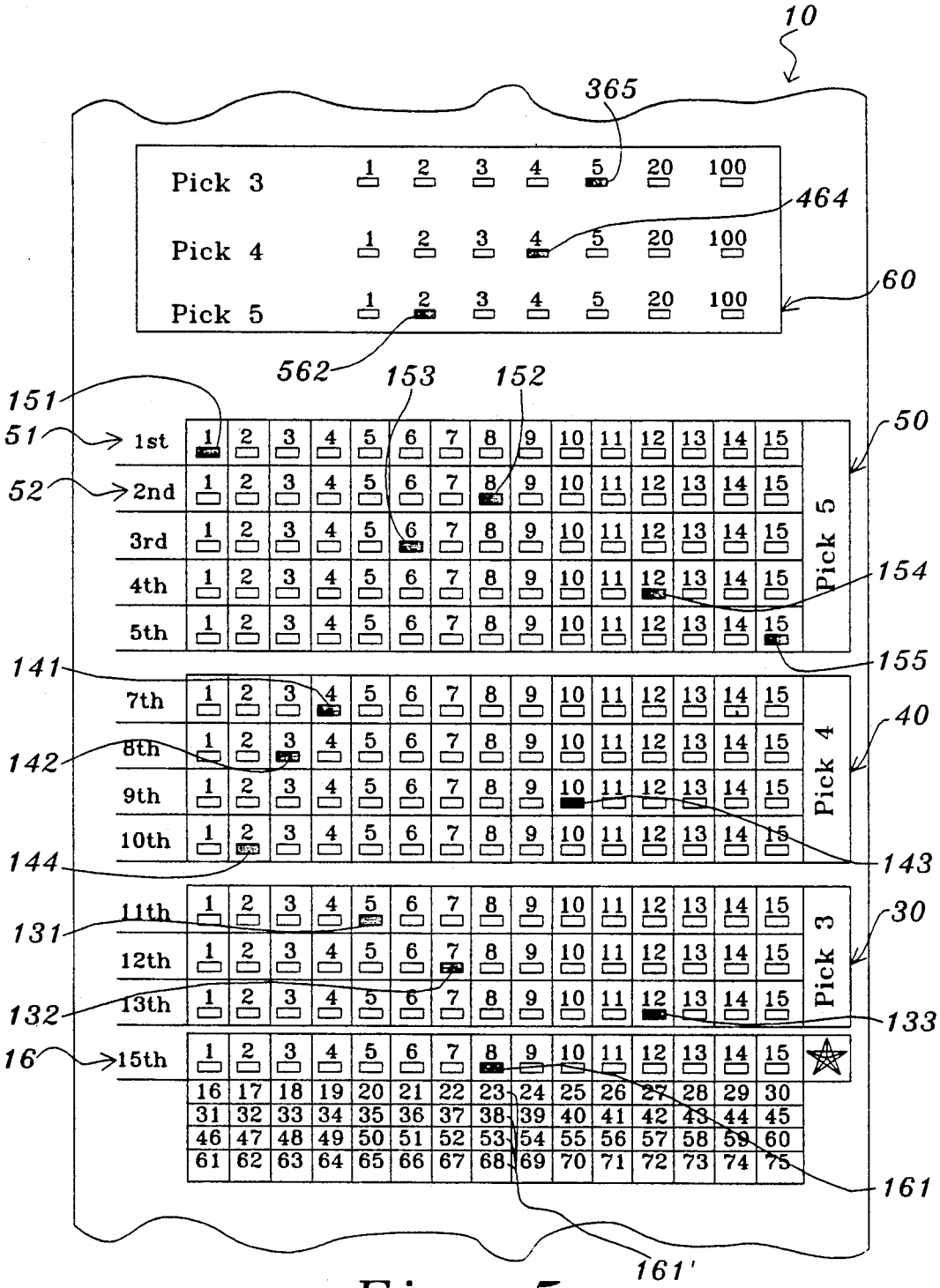
FIG. 5 illustrates an the embodiment of the game card of the present invention as seen in FIG. 4 on which a player has recorded guesses, it being understood that the stipuling has been used to illustrate the player's guesses, as will be explained below.

FIG. 5 illustrates game card 10, as seen in FIG. 4, after being marked with Player's guesses, it being understood that stipling has been used to indicate the marks that Player would make with pen or pencil on game card 10 to indicate his guesses. Fields 365, 464 and 562 have been marked by Player to indicate that her guesses for game 30 are valid for five rounds, her guesses for game 40 are valid for four rounds and her guesses for game 50 are valid for two rounds. In, row 16, Player has also marked field 161 which is associated with the group designator labelled with the number eight ("8"). If this single guess is correct, i.e if the number eight is the fifteenth number called during a round of bingo, then, in the preferred associated playing method, Player would be rewarded a free round, i.e. Player's guesses for each game would be valid for an additional round. However, in accordance with the preferred playing method, if the number twenty-three, thirty-eight, fifty-three or sixty-eight, each designated as 161', were the fifteenth number called, this would also be credited to Player as a correct guess.

In game 50, Player has marked fields 151, 152, 153, 154 and 155. Thus, Player has guessed that the number one will be the first number called in a round of bingo. In accordance with the preferred playing method, Player would also be credited with a correct guess if either the number sixteen (I16), the number 31, the number 46 or the number 61 was the first number called. Likewise, Player has guessed that the number eight, or either of the numbers in its associated group, will be the second number called during a round of bingo. This guess is indicated by Player's shading in field 152. Continuing, Player has guessed that the numbers six, twelve and fifteen will be the third, fourth and fifth numbers, respectively, called during a bingo round. These guesses are indicated by the player's shading of fields 153, 154 and 155. Thus, if the numbers one, eight, six, twelve and fifteen were the first, second, third, fourth and fifth numbers, respectively, called during a single round of bingo, Player would win game 50. Similarly, Player would win if the either of numbers in the groups associated with Player's guesses were the first through the fifth numbers called during a single round of bingo.

Game 40 and game 30 are played in a similar fashion except game 40 only requires Player to guess the sequence of four numbers and game 30 only requires Player to guess the sequence of three numbers. Player's guesses for game 40 are indicated by Player's shading of fields 141, 142, 143 and 144. Thus, if the number four or either of the numbers in its associated group is the seventh number called, the number three or either of the numbers in its associated group is the eighth number called, the number ten or either of the numbers in its associated group is the ninth number called, and the number two or either of the numbers in its associated group is the tenth number called, Player would win game 40.

Similarly, game 30 only requires Player to guess the sequence of three numbers. Player's guesses for game 30 are indicated by Player's shading of fields 131, 132, and 133. Thus, if the number five or either of the numbers in its associated group is the eleventh number called, the number seven or either of the numbers in its associated group is the twelfth number called and the number thirteen or either of the numbers in its associated group is the thirteenth number called, Player would win game 30.

In alternate embodiment of the associated playing method, Player could also be rewarded for correctly guessing the identity of a selected quantity of randomly generated numbers regardless of whether Player has correctly guessed the number's sequence. Thus, Player would be rewarded for correctly guessing the identity of five, in game 50, the identity of four, in game 40 or the identity of three, in game 30, of the first fifteen numbers called during a single round of bingo, but not correctly guessing their sequence. Preferably, Player's reward would be less for guessing identity, but not sequence, correctly, than if Player also correctly guessed sequence. A single correct guess in row 16 would entitle the player to a lesser prize, i.e. a free round.

From the foregoing description, it will be recognized by those skilled in the art that a game card and an associated playing method offering advantages over the prior art has been provided. Specifically, the game card and the associated playing method provides a game that alters a players perception of the odds of correctly guessing the identity and sequence of a series of randomly generated numbers. Also provided is a game card and an associated playing method in which a player can guess on a series of alphanumeric characters and/or icons in which each alphanumeric character and/or icon is equivalent to a limited group of numbers from a range of randomly generated numbers and which a player's guesses are recorded so as to allow verification of the accuracy of the player's guesses by an optical or magnetic reader.

While a preferred embodiment has been shown and described, it will be understood that it is not intended to limit the disclosure, but rather it is intended to cover all modifications and alternate methods falling within the spirit and the scope of the invention as defined in the appended claims.

Having thus described the aforementioned invention, I claim:

1. A method for playing a number game of chance for use by at least one player, said method comprising the steps of:

providing a plurality of numbers;

providing at least one game card per player, said plurality of numbers being imprinted upon said at least one game card, said plurality of numbers being divided into a plurality of groups of numbers, each of said plurality of groups of numbers being associated with a group designator, said group designator being arranged in a set of group designators, each of said game cards having a plurality of sets of group designators;

making a plurality of guesses by said player, each of said plurality of guesses including choosing a selected group designator in a selected set of said plurality of sets of group designators, one said selected group designator being selected from each of said plurality of sets of group designators to complete each of said at least one game cards;

marking one of said at least one game cards with each of said plurality of guesses wherein each of said plurality of guesses is indicated by marking said selected group designator in said selected set of said plurality of sets of group designators;

randomly generating a series of numbers from said plurality of numbers, said randomly generated series of numbers including at least as one for each of said plurality of guesses; and comparing each of said plurality of guesses by said player with a selected number from said randomly generated series of numbers to determine if said selected group designator is associated with said group of numbers including said selected number from said randomly generated series of numbers, a correct guess comprising a guess of said selected group designator which is associated with said group of numbers including said selected number from said randomly generated series of numbers.

2. The method of claim 1 wherein said randomly generated series of numbers is randomly generated during a game of bingo.

3. The method of claim 1 wherein said randomly generated series of numbers is randomly generated during a game of keno.

4. The method of claim 1 wherein said randomly generated series of numbers is randomly generated during a lottery.

5. The method of claim 1 wherein said plurality of guesses are indicated on said at least one game card such that said plurality of guesses is readable by an optical scanner.

6. The method of claim 1 wherein said at least one game card allows a plurality of guessing games to be played on a single game card.

7. The method of claim 1 wherein said group designator is a numeric character.

8. The method of claim 1 wherein said group designator is an alphabetic character.

9. The method of claim 1 wherein said group designator is a graphical symbol.

10. The method of claim 1 wherein said at least one game card is graphically displayed on a video-game monitor.

11. The method of claim 1, after the step of comparing each of said plurality of guesses by said player with a selected number from said randomly generated numbers, further comprising the step of determining an award based on a number of said correct guesses and a sequence of said correct guesses.

12. The method of claim 11 wherein said award is determined according to a preselected subgroup of said plurality of guesses.

13. The method of claim 12 wherein an award is given when each said randomly generated number is correctly guesses within said preselected subgroup of said plurality of guesses in an incorrect sequence.

14. The method of claim 1 further comprising the step of marking said at least one game card to indicate a selected number of said games for which said selected guesses are to be compared with said series of randomly generated numbers.

15. A method for playing a number game of chance for use by at least one player, said method comprising the steps of:

providing a plurality of numbers;

providing at least one game card per player, said plurality of numbers being imprinted upon said at least one game card, said plurality of numbers being divided into a plurality of groups of numbers, each of said plurality of groups of numbers being associated with a group designator, said group designator being arranged in a set of group designators, each of said game cards having a plurality of sets of group designators;

making a plurality of guesses by said player, each of said plurality of guesses including choosing a selected group designator in a selected set of said plurality of sets of group designators, one said selected group designator being selected from each of said plurality of sets of group designators to complete each of said at least one game cards;

marking one of said at least one game cards with each of said plurality of guesses wherein each of said plurality of guesses is indicated by marking said selected group designator in said selected set of said plurality of sets of group designators;

randomly generating a series of numbers from said plurality of numbers, said randomly generated series of numbers including at least as one for each of said plurality of guesses;

comparing each of said plurality of guesses by said player with a selected number from said randomly generated series of numbers to determine if said selected group designator is associated with said group of numbers including said selected number from said randomly generated series of numbers, a correct guess comprising a guess of said selected group designator which is associated with said group of numbers including said selected number from said randomly generated series of numbers; and determining an award based on a number of said correct guesses and a sequence of said correct guesses, said award being determined according to a preselected subgroup of said plurality of guesses.

16. The method of claim 15 wherein said randomly generated series of numbers is randomly generated during a game of bingo.

17. The method of claim 15 wherein said randomly generated series of numbers is randomly generated during a game of keno.

18. The method of claim 15 wherein said randomly generated series of numbers is randomly generated during a lottery.

19. The method of claim 15 wherein an award is given when each said randomly generated number is correctly guessed within said preselected subgroup of said plurality of guesses in an incorrect sequence.

20. The method of claim 19 wherein said randomly generated series of numbers is randomly generated during a game of bingo.

21. The method of claim 19 wherein said randomly generated series of numbers is randomly generated during a game of keno.

22. The method of claim 19 wherein said randomly generated series of numbers is randomly generated during a lottery.

23. The method of claim 19 wherein said at least one game card is graphically displayed on a video-game monitor.

24. The method of claim 15 wherein said at least one game card is graphically displayed on a video-game monitor.

* * * * *